US005624171A

United States Patent [19]

Soja et al.

[11] Patent Number: 5,624,171

[45] Date of Patent: Apr. 29, 1997

[54] TWO-TRACK DRAWER SLIDE HAVING FUNCTION OF THREE-TRACK SLIDE

[75] Inventors: Joseph F. Soja, Wethersfield; Chester M. Fudge, Middletown, both of Conn.

[73] Assignee: Durham Manufacturing Company, Durham, Conn.

[21] Appl. No.: 506,229

[22] Filed: Jul. 24, 1995

[51] Int. Cl.[6] ..... A47B 88/10; A47B 88/12; A47B 88/16

[52] U.S. Cl. ..... 312/334.8; 312/348.2; 312/334.7; 312/334.44

[58] Field of Search ..... 312/334.44, 348.1, 312/348.2, 334.1, 334.7, 334.8, 330.1, 334.4, 265.4; 211/151

[56] References Cited

U.S. PATENT DOCUMENTS

| | | | |
|---|---|---|---|
| 1,301,495 | 4/1919 | Otte | 312/334.8 X |
| 1,518,687 | 12/1924 | Bullock | 312/333 X |
| 1,963,220 | 6/1934 | Anderson | 312/334.8 X |
| 4,303,286 | 12/1981 | McClellan | 312/330.1 X |
| 4,440,461 | 4/1984 | Powell et al. | 312/334.8 |
| 4,569,563 | 2/1986 | Fourrey | 312/333 X |
| 4,925,258 | 5/1990 | Ludwig et al. | 312/348.1 X |
| 5,211,461 | 5/1993 | Teufel et al. | 312/334.8 X |
| 5,378,057 | 1/1995 | Bach et al. | 312/334.4 X |
| 5,433,516 | 7/1995 | Beals et al. | 312/263 X |
| 5,435,640 | 7/1995 | Holcomb | 312/333 X |

FOREIGN PATENT DOCUMENTS

| | | | |
|---|---|---|---|
| 159799 | 11/1954 | Australia | 312/330.1 |
| 2382215 | 9/1978 | France | 312/265.4 |

*Primary Examiner*—Peter M. Cuomo
*Assistant Examiner*—David E. Allred
*Attorney, Agent, or Firm*—John H. Crozier

[57] ABSTRACT

A drawer cabinet having side walls joined at front edges thereof by a front surface, with at least one two-track drawer slide assembly including: outer tracks axially slidably mounted in supports attached to the side walls; inner tracks telescopingly axially moveable within the outer tracks, the inner tracks being moveable between: (1) a first, closed position, with the inner tracks fully inserted in, and supported by, the outer tracks, and with the outer tracks fully disposed within the cabinet, and (2) a second, withdrawn position, with the inner tracks being nearly fully withdrawn from the outer tracks past the front surface, yet remaining supported by the outer tracks, and with the outer tracks fully disposed within the cabinet; and a frame attached to the inner tracks, the frame not being fully withdrawn past the front surface when the inner tracks are in the second, withdrawn position; and co-engaging apparatus attached to the inner and outer tracks to become engaged when the inner tracks are withdrawn to the second position, with further withdrawal of the inner tracks past the front surface causing the outer tracks to move axially partially outwardly of the front surface, to move the inner tracks to a third, withdrawn position, to permit the frame to be fully withdrawn past the front surface.

19 Claims, 9 Drawing Sheets

TWO-TRACK DRAWER SLIDE HAVING FUNCTION OF THREE-TRACK SLIDE

BACKGROUND OF THE INVENTION

1. Field of the Invention

The present invention relates to cabinet drawers generally and, more particularly, but not by way of limitation, to a novel two-track drawer slide which functions as a three-track slide.

2. Background Art

Modern cabinet drawers typically have slide mechanisms on either side of each drawer to support the drawer and to provide smooth opening and closing of the drawer as the drawer is withdrawn from and slid into the cabinet.

In its basic form, a modern drawer slide of such type includes first horizontal tracks fixed to the cabinet frame on either side of the cabinet opening for each drawer. Corresponding second horizontal tracks are fixed to either side of each drawer for the engagement of the first tracks by the second tracks and movement of the drawer in and out of the cabinet. In some cases, it is necessary that the drawer fully extend from the cabinet; that is, with the back wall of the drawer disposed outwardly of the front wall of the cabinet when the drawer is fully withdrawn from the cabinet, yet still supported therein. An example of such requirement is where the drawer includes a box with a lid and full withdrawal of the drawer is required so that the lid can be opened and tilted backwardly slightly so that materials in the box can be accessed without having to continuously manually hold the lid open. This requires that the second horizontal tracks extend rearwardly from the back wall of the box such that the second tracks will engage the first tracks sufficiently to support the drawer in fully extended position. This consumes an unnecessary volume of unused space in the rear of the cabinet when the drawer is fully closed.

In a further development, a third set of tracks is provided telescopingly between the first and second sets of tracks so that the drawer can be fully extended as above, but without the necessity of creating unused space. While this arrangement is satisfactory, insofar as the operation of the drawer is concerned, a relatively large number of parts is required, with the concomitant more costly manufacturing cost.

A further disadvantage of conventionally constructed cabinet drawer slide mechanisms is that spot welding is employed during the manufacture thereof. This requires subsequent priming and painting steps which are relatively costly and somewhat unsatisfactory when working with assembled parts.

Accordingly, it is a principal object of the present invention to provide a cabinet drawer slide mechanism that is simple in construction, yet permits a drawer to be fully withdrawn from the cabinet in open position without requiring excessive unused volume in the rear of the cabinet.

It is a further object of the invention to provide such a drawer slide mechanism that is economically manufactured.

It is more specifically an object of the invention to provide such a drawer slide mechanism in which a two-track slide functions as a three-track slide.

It is an additional object of the invention to provide a construction technique for drawer slides that eliminates the spot welding conventionally employed.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a drawer cabinet having first and second, spaced apart, parallel, vertical side walls joined at front edges thereof by a front surface, said drawer cabinet having at least one two-track drawer slide assembly having the function of a three-track drawer slide assembly, said two-track drawler slide assembly comprising: first and second horizontal, parallel, oppositely disposed outer tracks axially slidably mounted in support means attached to said first and second side walls, respectively; first and second, parallel, inner tracks telescopingly axially moveable within said first and second outer tracks, said inner tracks being moveable between: (1) a first, closed position, with said inner tracks fully inserted in, and supported by, said outer tracks, and with said outer tracks fully disposed within said drawer cabinet, and (2) a second, withdrawn position, with said inner tracks being nearly fully withdrawn from said outer tracks past said front surface of said drawer cabinet, yet remaining supported by said outer tracks, and with said outer tracks fully disposed within said drawer cabinet; and a frame attached to said first and second inner tracks, said frame not being fully withdrawn past said front surface of said drawer cabinet when said inner tracks are in said second, withdrawn position; and co-engaging means attached to said inner and outer tracks to become engaged when said inner tracks are withdrawn to said second, withdrawn position, with further withdrawal of said inner tracks past said front surface of said drawer cabinet causing said outer tracks to move axially partially outwardly of said front surface of said drawer cabinet, to move said inner tracks to a third, withdrawn position, to permit said frame to be fully withdrawn past said front surface of said drawer cabinet.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
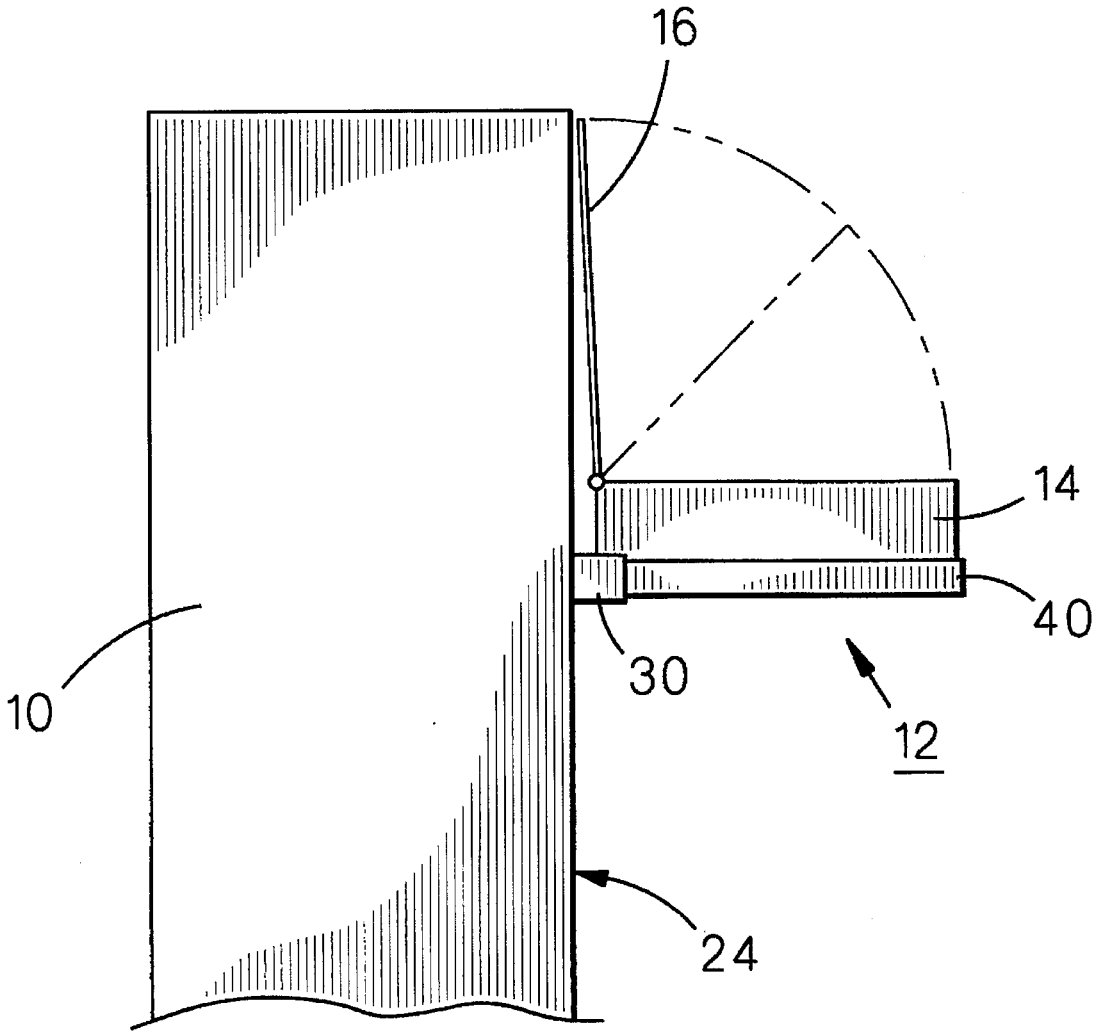
FIG. 1 is a fragmentary, side elevational view of a cabinet with a drawer extending therefrom, the cabinet and drawer having a slide structure constructed according to the present invention, with a box mounted thereon.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates a drawer cabinet 10, having a front surface 24, and having a single drawer assembly 12 extending therefrom. Drawer assembly 12 includes a parts bin 14 mounted thereon. It can be seen that drawer assembly 12 has been withdrawn sufficiently from cabinet 10 that lid 16 can be opened fully (solid line) such that it has been rotated somewhat rearwardly of the back wall of the parts bin to permit materials in the parts bin to be accessed without having to continuously manually hold the lid open. Drawer assembly 12 could also be of the type in which a plurality of vertical files are disposed and full extension of drawer 12 is required for convenient access thereto.

Figure 2:
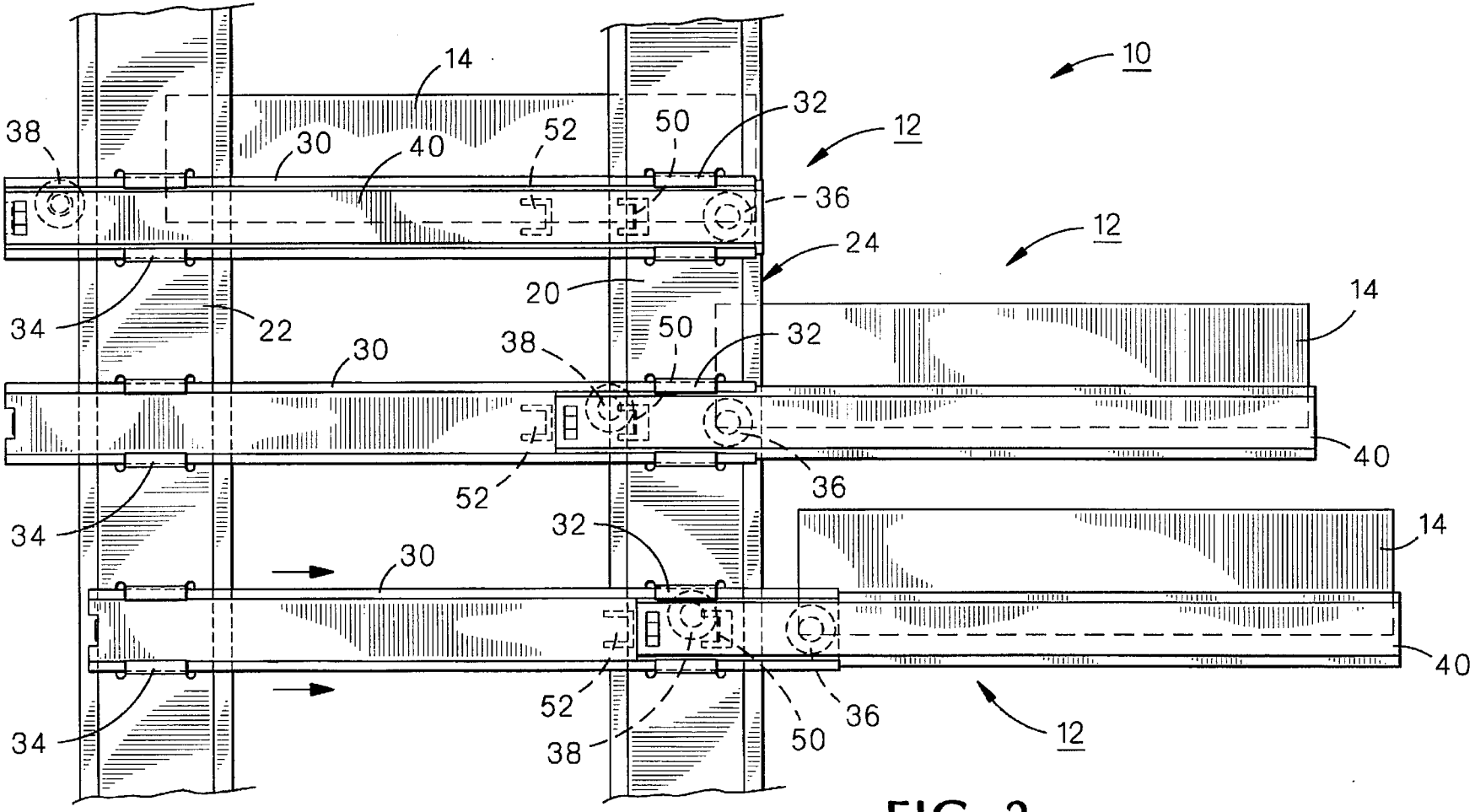
FIG. 2 is a fragmentary, cut-away, side elevational view, in cross-section, of the cabinet of FIG. 1.

Reference should now be made to FIG. 2 which illustrates three identical drawer assemblies 12 in cabinet 10 and which generally illustrates the overall construction and operation of the drawer slide mechanism of the present invention. Cabinet 10 includes front and rear longitudinally vertical structural members 20 and 22, respectively, the forward edge of the front structural member terminating at or near the front surface 24 of the cabinet, the front surface joining the two sides of the drawer cabinet. Each drawer assembly 12 includes a first, outer, horizontal track 30 held in U-shaped channels 32 and 34 as one piece with the respective vertical structural member formed, respectively, in front and rear structural members 20 and 22. The outer horizontal track is received between first and second legs of the U-shaped channels 32, 34. Each drawer assembly 12 also includes a second, inner, horizontal track 40 which is telescopingly axially moveable within outer track 30, in the conventional manner of two-track slide mechanisms.

A first wheel 36 is rotatingly mounted in outer track 30 proximate the front end thereof for the engagement and support of inner track 40. A second wheel 38 is rotatingly mounted in inner track 40 proximate the rear thereof to engage outer track 30 as a drawer assembly 12 is moved to an open position, also in the conventional manner of two-track slide mechanisms.

Figure 3:
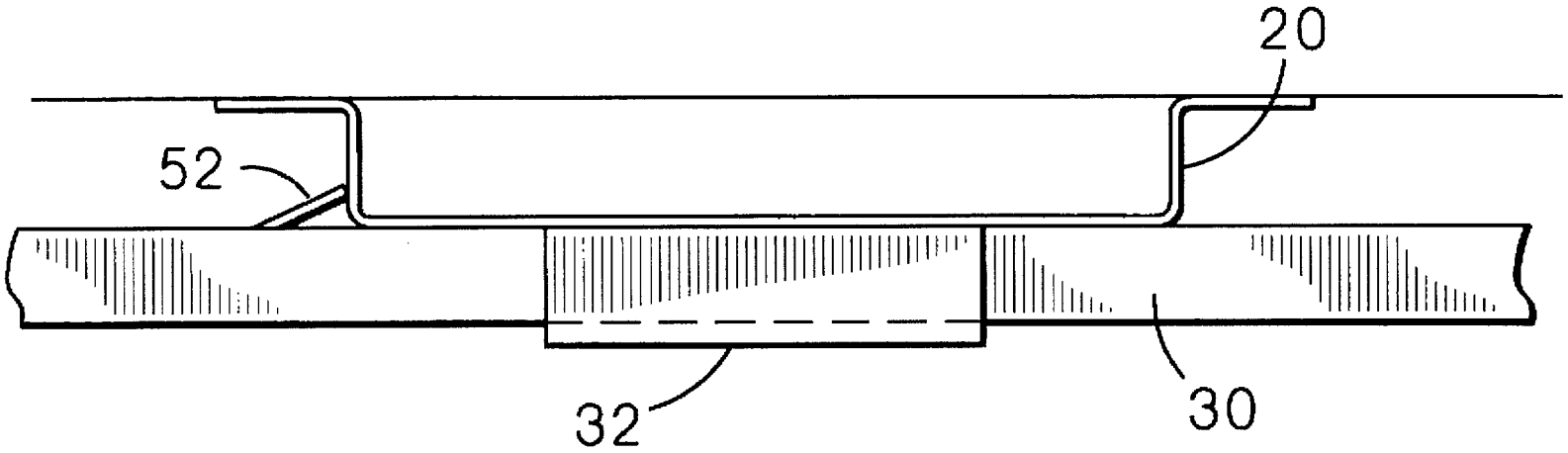
FIG. 3 is a fragmentary, top plan view of a portion of the drawer slide structure.

Upper drawer assembly 12 is shown in a fully closed position. Middle drawer assembly 12 is shown as having been opened to the extent that a two-track slide would normally permit; that is, with inner track 40 sufficiently engaging outer track 30 to provide support for parts bin 14. In the case of the present invention, however, once middle drawer assembly reaches the position shown, second wheel 38 engages a first vertical tab 50 formed interiorly of outer track 30 as a inwardly bent portion of the wall of the outer track, that is, toward the viewer. With wheel 38 and first tab 50 so engaged, further withdrawal force on drawer assembly 12 results in outer track 30 sliding axially within channels 32 and 34, as indicated by the arrows on FIG. 2, so that the front end of the track extends somewhat forwardly of front side 24 of cabinet 10 to the position shown for lower drawer assembly 12. This causes parts bin 14 to be fully withdrawn from cabinet 10 so that lid 16 on the parts bin may be fully opened (FIG. 1). Further axial movement of outer track 30 is prevented by the engagement of a second vertical tab 52, formed exteriorly of the outer track as an outwardly bent portion of the wall of the outer track, that is, away from the viewer, with an inner edge of vertical frame member 20. This is seen more clearly on FIG. 3.

Figure 4:
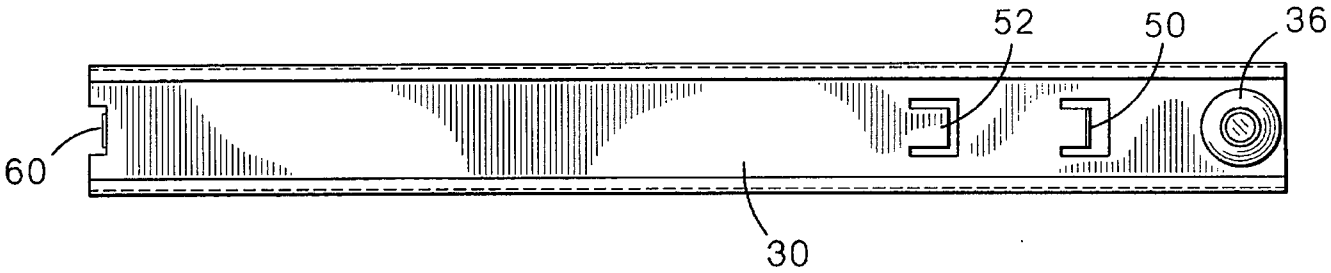
FIG. 4 is a side elevational view of an outer slide track of the present invention.
Figure 5:
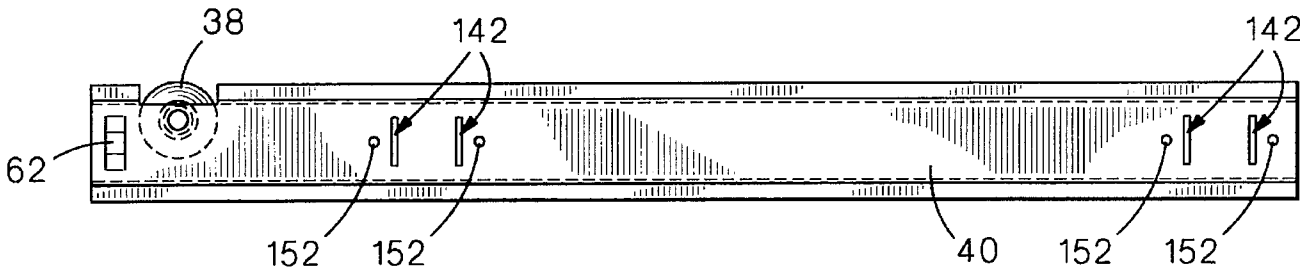
FIG. 5 is a side elevational view of an inner slide track of the present invention.
Figure 6:
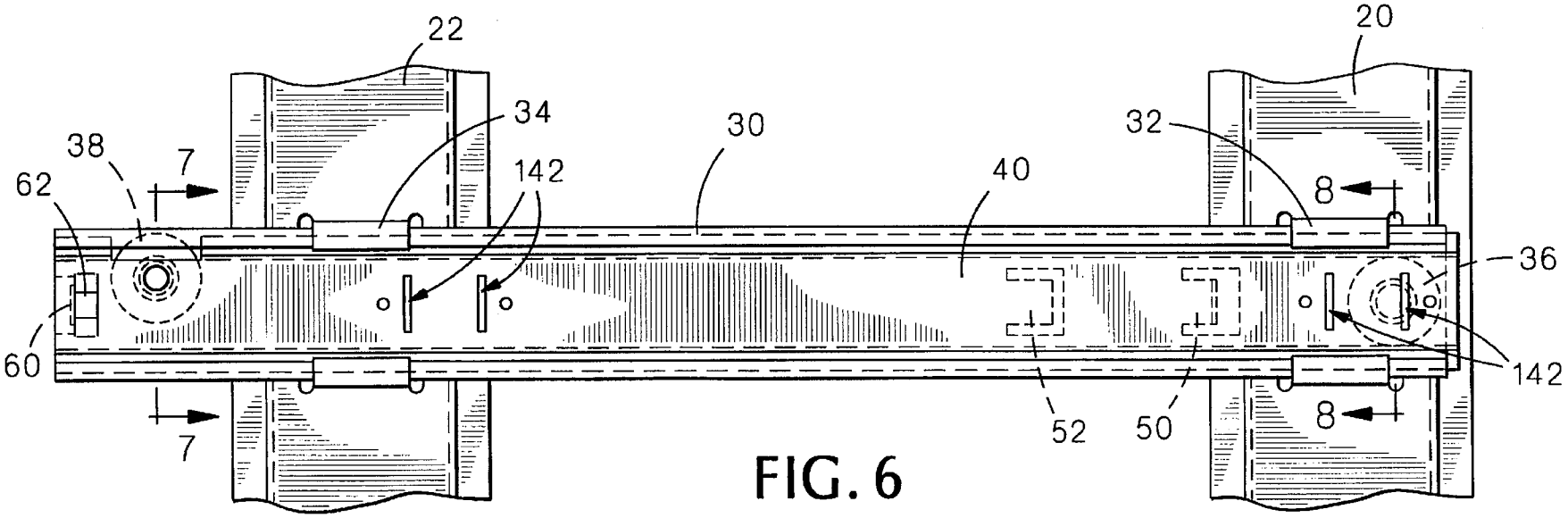
FIG. 6 is a fragmentary, side elevational view of the inner and outer slide tracks assembled.

FIGS. 4, 5, and 6 illustrate more clearly the construction relationship of outer and inner tracks 30 and 40, those figures being somewhat enlarged compared to FIG. 2. Referring to FIG. 4, a third tab 60 formed from the wall of outer track 30 is bent inwardly therefrom, that is, toward the viewer of that figure. Referring to FIG. 5, a complementary stop 62 formed from the wall of inner track 40 is bent outwardly therefrom, that is, away from the viewer of that figure. When inner track 40 is fully inserted in outer track 30, stop 62 engages third tab 60, as is shown on FIG. 6 to prevent further movement of inner track 40 into cabinet 10 (FIG. 1).

Figure 7:
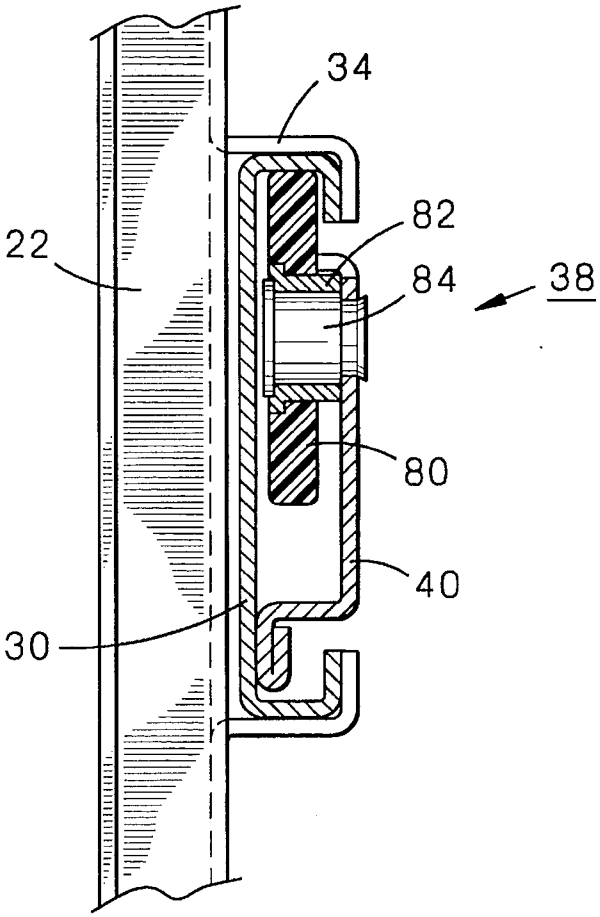
FIG. 7 is a fragmentary, cross-sectional view taken along line "7—7" of FIG. 6.

FIG. 7 illustrates the construction of second wheel 38, as well as details of construction of outer track 30 and inner track 40. Outer track 30 is cup-shaped in cross-section, with opposite end walls having distal edges terminating in inwardly facing flanges 70 and 72 for structural rigidity and to form a channel for the axial movement therein of inner track 40. Second wheel 38 includes an outer rim 80 of a relatively hard polymeric material, such as nylon, which engages the upper inner peripheral surface of outer track 30 and which has a centrally disposed metallic bushing 82 journaled for rotation on a shaft 84 which is staked to the vertical wall of inner track 40.

Figure 8:
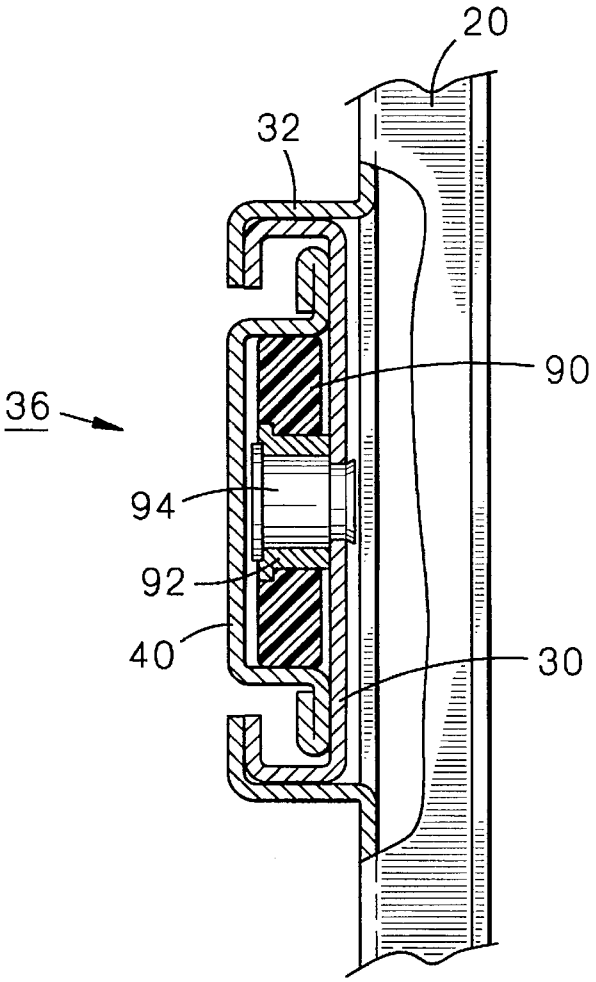
FIG. 8 is a fragmentary, cross-sectional view, partially cut-away, taken along line "8—8" of FIG. 6.

FIG. 8 illustrates the construction of first wheel 36, as well as details of the construction of outer track 30 and inner track 40. Inner track is cup-shaped, with opposite end walls having distal edges terminating in outwardly facing, folded-over flanges for structural rigidity. First wheel 36 includes an outer rim 90 of a relatively hard polymeric material, such as nylon, which engages the upper and lower inner peripheral surfaces of inner track 40 and which has a centrally disposed metallic bushing 92 journaled for rotation on a shaft 94 which is staked to the vertical wall of outer track 30.

Drawer assemblies 12 (FIG. 2) are illustrated primarily as each having first pairs of outer and inner tracks 30 and 40 provided at one side of drawer cabinet 10. It will be understood, from the foregoing description, that second pairs of identical, but mirror image, outer and inner tracks 30 and 40 will be provided at the opposite sides of drawer assemblies 12.

Figure 10:
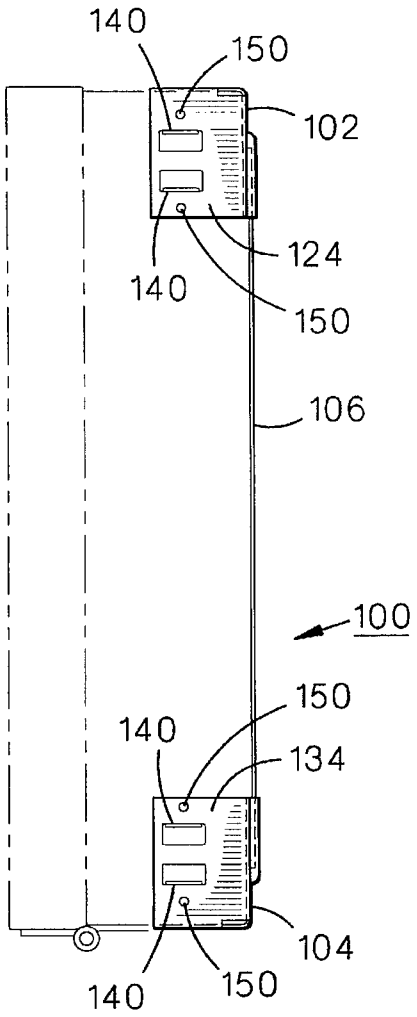
FIG. 10 is a side elevational view of the frame of FIG. 9.
Figure 9:
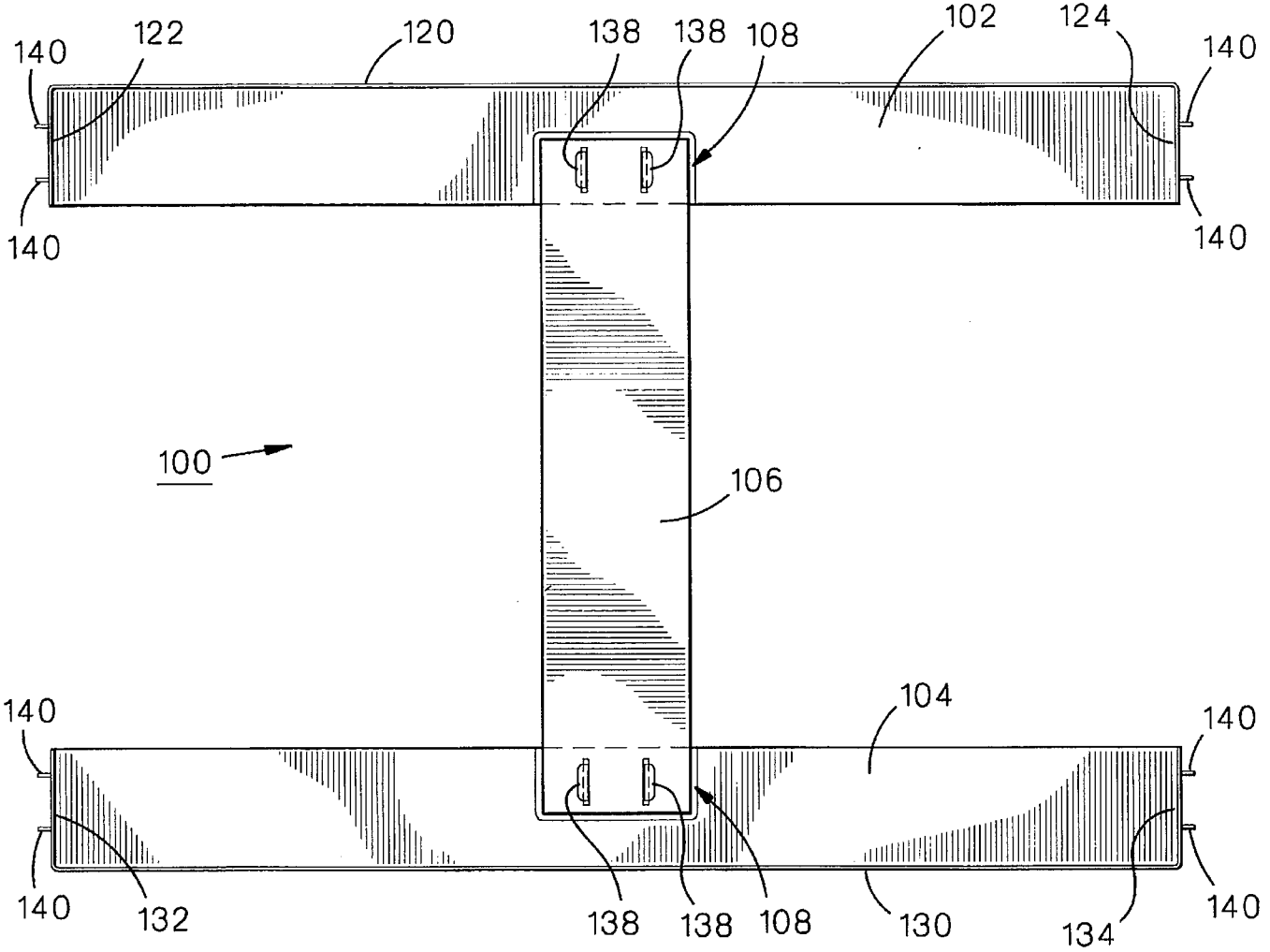
FIG. 9 is a top plan view of a support frame for the box of FIG. 1.

FIGS. 9 and 10 illustrate the construction of a frame, generally indicated by the reference numeral 100, for the support of parts bin 14 (FIGS. 1 and 2). Frame 100 includes spaced apart, parallel, front and rear stringers 102 and 104, respectively, joined by an intermediate member 106 disposed orthogonally to the front and rear stringer. The distal ends of intermediate member 106 are set into depressions 108 formed in front and rear stringers 102 and 104 so that the upper surfaces of the stringers and the intermediate member are flush. Front stringer 102 includes a side wall 120 and end walls 122 and 124. Similarly, rear stringer 104 includes a side wall 130 and end walls 132 and 134. The construction of frame 100 thus comprises planar surfaces having walls disposed around the distal peripheral edges thereof for the secure support of parts bin 14 therein (FIG. 1).

Front and rear stringers 102 and 104 include upwardly formed tabs which are inserted through complementarily shaped slots defined near the distal ends of intermediate member 106 and bent over to lock the three structural elements together. In a similar manner, end walls 122, 124, 132, and 134 have outwardly formed tabs which are employed to fasten frame 100 to inner track 40. Referring to FIGS. 5 and 6, inner track 40 has defined therethrough complementarily shaped slots 142 through which tabs 140 are inserted (not shown) and subsequently bent over to secure frame 100 to the inner track, similar to the bending of tabs 138 shown on FIG. 9.

End walls 124 and 134 further include convex dimples 150 (FIG. 10) formed therein which engage complementarily formed concave dimples 152 (FIG. 5) formed in the mating inner surface of the vertical wall of inner track 40 to provide for locating end walls 124 and 134 with respect to the inner track prior to bending tabs 140.

The use of tabbed construction techniques in the present invention eliminates the use of the spot welds employed in conventional construction of cabinet drawers and, thus, eliminates the need for additional priming and painting steps. In fact, the construction techniques of the present invention permit the assembly of fully finished parts.

Figure 11:
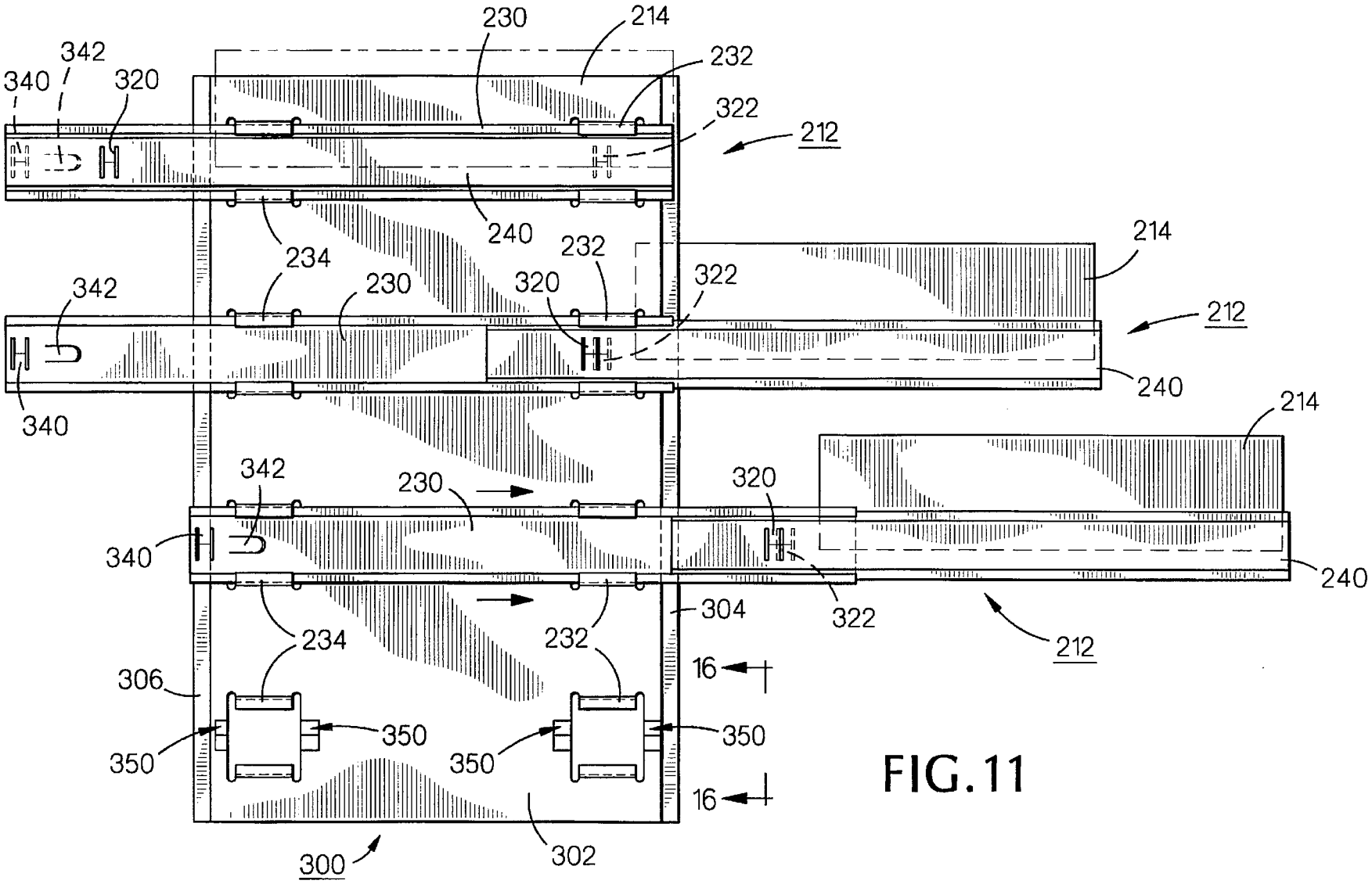
FIG. 11 is a side elevational view of an alternative embodiment of the present invention.

FIG. 11 illustrates an alternative embodiment of the present invention with three identical drawer assemblies 212 having mounted thereon parts bins 214, the drawer assemblies operating in essentially the same manner as drawer assemblies 12 on FIG. 2, the differences therebetween being in construction details, as described below.

In the alternative embodiment, vertical support structural members 20 and 22 (FIG. 2) have been replaced with a single longitudinally vertical support panel, generally indicated by the reference numeral 300, and having a raised central portion 302. Vertical flanges 304 and 306 formed along the front and rear edges of support panel 300 provide members for mounting the support panel to an inside surface of a sidewall of a cabinet (not shown).

Outer and inner horizontal tracks 230 and 240, respectively, are provided for each drawer assembly similar to tracks 30 and 40 of drawer assemblies 12 (FIG. 2), except that wheels 36 and 38 of the latter have been omitted from the former, such that inner track 240 directly engages and slides within outer track 30. Outer track 230 is sliding supported, respectively, in U-shaped channels 232 and 234 formed in the central portion of the support panel 300. The u-shaped channels are formed as one piece with the support panel 300 by first and second legs extending out of the central portion 302 and receiving the outer tracks 230 therebetween.

As inner track 240 is drawn from the front of a cabinet (not shown), an outwardly bent tab 320 formed on inner track 240 engages an inwardly bent tab 322 formed on outer track 230 and begins drawing the front end of the outer track from the front edge (not shown) of the cabinet, as the outer track slides in channels 232 and 234. Such movement of outer and inner tracks 230 and 240 terminates when an outwardly bent tab 340 engages the rear end of central portion 302 of support panel 300, in the same manner as tab 52 on FIG. 3. When inner track 240 is fully inserted in outer track 230, an inwardly bent tab 342 formed on the outer track engages tab 320 to prevent the inner track from backing out of the outer track.

Figure 12:
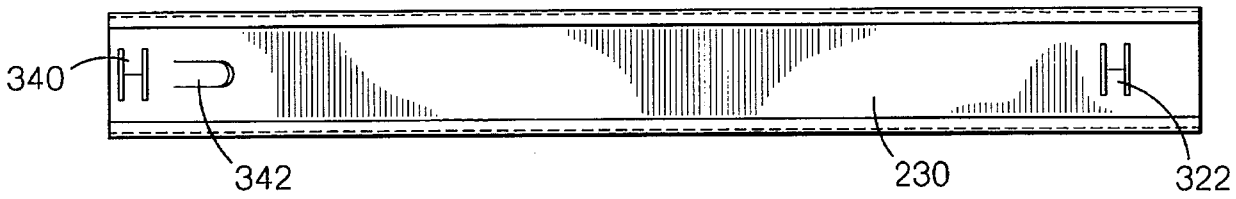
FIG. 12 is a side elevational view of an outer slide track of the alternative embodiment of the present invention.
Figure 13:
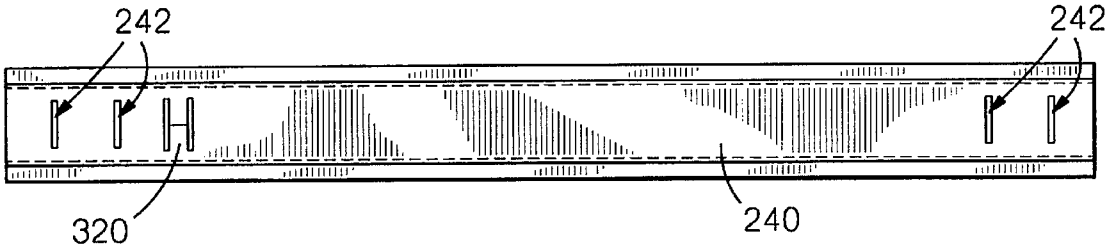
FIG. 13 is a side elevational view of an inner slide track of the alternative embodiment of the present invention.
Figure 14:
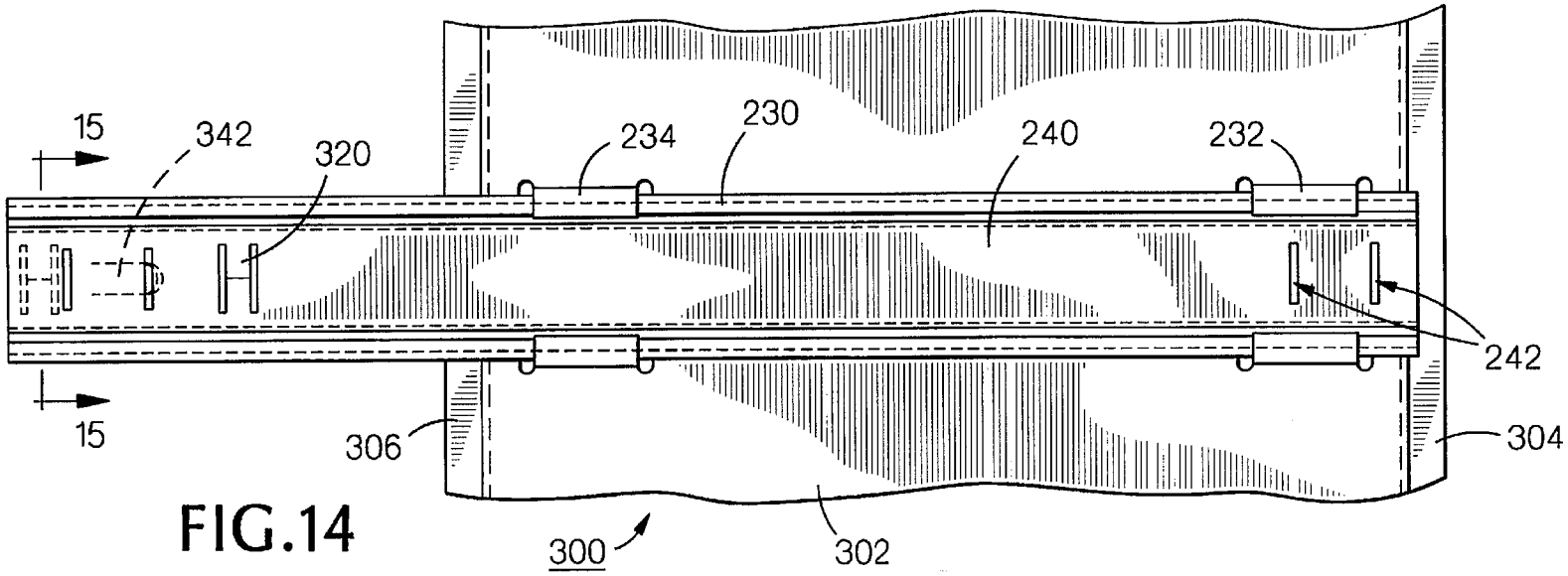
FIG. 14 is a fragmentary, side elevational view of the inner and outer slide tracks assembled in the alternative embodiment of the present invention.

FIGS. 12, 13, and 14 illustrate more clearly the construction relationship of outer and inner tracks 230 and 240, the elements thereof having been described with reference to FIG. 11, except elements 242 which have the same function as elements 142 on FIGS. 5 and 6.

Figure 16:
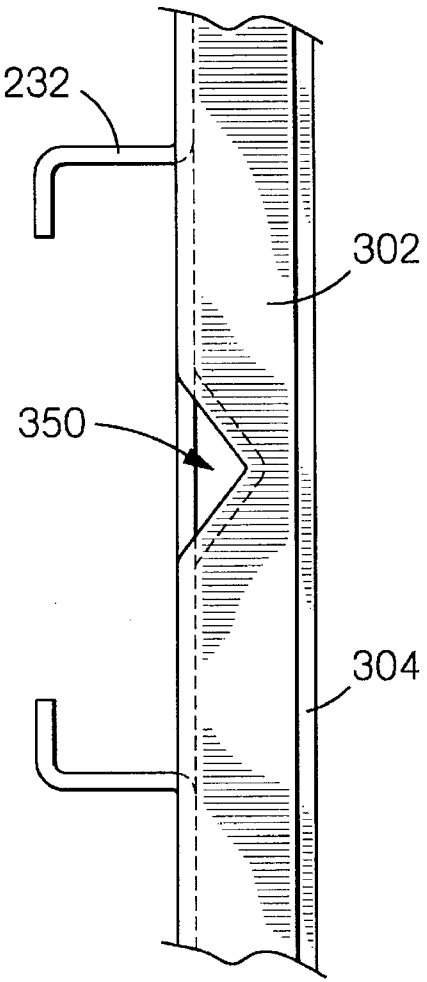
FIG. 16 is a fragmentary, front elevational view of the alternative embodiment of the present invention.
Figure 15:
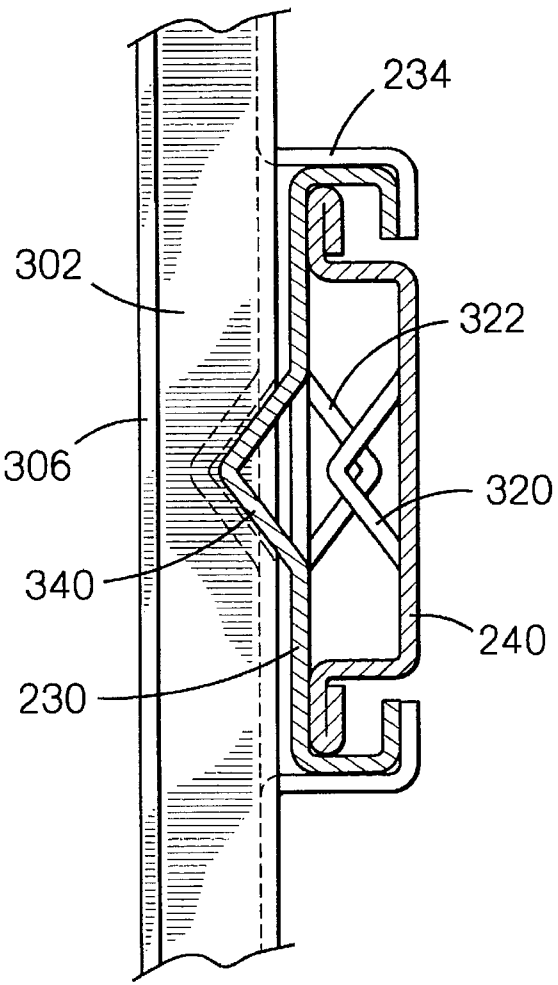
FIG. 15 is a fragmentary, cross-sectional view taken along line "7—7" of FIG. 6.

FIGS. 15 and 16 are rear and front elevational views, respectively, further illustrating the arrangement of some of the elements described above with reference to FIGS. 11–14.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. A drawer cabinet having first and second, spaced apart, parallel, vertical side walls joined at front edges thereof by a front surface, said drawer cabinet having at least one two-track drawer slide assembly having the function of a three-track drawer slide assembly, said two-track drawer slide assembly comprising:

(a) first and second horizontal, parallel, oppositely disposed outer tracks axially slidably mounted in support means attached to said first and second side walls, respectively;

(b) said support means comprising at least one longitudinally vertical support member for each of said side walls of said cabinet, each vertical flanges formed along front and rear edges of the support member for mounting said vertical support member to and inside of each of said side walls, at least one U-shaped channel formed as one piece with said support member, said U-shaped channel located on said central portion of each vertical support member, said U-shaped channel comprising first and second legs receiving said outer-tracks therebetween; first and second, parallel, inner tracks telescopingly axially moveable within said first and second outer tracks, said inner tracks being moveable between: (1) a first, closed position, with said inner tracks fully inserted in, and supported by, said outer tracks, and with said outer tracks fully disposed within said drawer cabinet, and (2) a second, withdrawn position, with said inner tracks being substantially fully withdrawn from said outer tracks past said front surface of said drawer cabinet, yet remaining supported by said outer tracks, and with said outer tracks fully disposed within said drawer cabinet;

(c) a frame fixedly attached to said first and second inner tracks, said frame not being fully withdrawn past said front surface of said drawer cabinet when said inner tracks are in said second, withdrawn position; and (d) co-engaging means attached to said inner and outer tracks to become engaged when said inner tracks are withdrawn to said second, withdrawn position, with further withdrawal of said inner tracks past said front surface of said drawer cabinet causing said outer tracks to move axially partially outwardly of said front surface of said drawer cabinet in response to said co-engaging means becoming engaged when said inner tracks are withdrawn to said second, withdrawn position, to move said inner tracks to a third, withdrawn position, to permit said frame to be fully withdrawn past said front surface of said drawer cabinet.

2. A drawer cabinet, as defined in claim 1, wherein:

(a) each said outer track includes a first wheel rotatingly mounted therein proximate an end thereof adjacent said front surface of said drawer cabinet for the engagement of inner peripheral surfaces of said inner track for support of said inner track; and (b) each said inner track includes a second wheel rotatingly mounted therein proximate an end thereof opposite said front surface of said drawer cabinet to engage an inner peripheral surface of said outer track for the support of said inner track.

3. A drawer cabinet, as defined in claim 1, wherein:

said inner and outer tracks co-engage in sliding direct contact.

4. A drawer cabinet, as defined in claim 1, wherein:

each of said outer tracks is slidably held in two U-shaped channels in horizontally spaced apart relationship.

5. A drawer cabinet, as defined in claim 1, wherein:

movement of each said outer track beyond said third, withdrawn position of said inner track is prevented by engagement of stop means formed on said outer track with a member fixed to a side of said drawer cabinet.

6. A drawer cabinet, as defined in claim 1, wherein:

said co-engaging means comprises: said second wheel and a tab formed on said outer track.

7. A drawer cabinet, as defined in claim 1, wherein:

said co-engaging means comprises: tabs formed on said inner and outer tracks.

8. A drawer cabinet, as defined in claim 1, wherein:

said frame comprises:

(a) spaced apart, parallel, front and rear stringers joined by an intermediate member disposed orthogonally to said front and rear stringers; and (b) said front and rear stringers and said intermediate member being joined together by upwardly extending tabs formed on said front and rear stringers, which tabs are inserted through complementarily shaped slots defined through said intermediate member near the ends thereof, said tabs being bent over to lock said front and rear stringers and said intermediate member together.

9. A drawer cabinet, as defined in claim 8, wherein:

said ends of said intermediate member are set into complementarily shaped depressions formed in said front and rear stringers so that upper surfaces of said stringers and said intermediate member are flush with each other.

10. A drawer cabinet, as defined in claim 9, wherein:

said front and rear stringers include side walls and end walls formed around the peripheral edges thereof and orthogonal to the upper surfaces thereof, such that said frame comprises planar surfaces having walls disposed at opposite distal edges thereof for the secure support therein of a parts bin.

11. A drawer cabinet, as defined in claim 8, wherein:

said front and rear stringers have end walls formed orthogonal to longitudinal of said stinger surfaces and said end walls include outwardly formed tabs which are inserted through complementarily formed slots in said inner tracks and which said tabs are then bent over to secure said frame to said inner tracks.

12. A drawer cabinet, as defined in claim 11, further comprising:

first dimples formed in said end walls, which first dimples engage complementarily formed second dimples formed in mating inner surfaces of said inner tracks to provide for locating said end walls with respect to said inner tracks prior to bending said tabs.

13. A drawer cabinet, as defined in claim 1, wherein:

construction of said frame and attachment of said frame to said inner tracks is accomplished without the use of spot welding.

14. A drawer cabinet, as defined in claim 13, wherein:

said construction of said frame and attachment of said frame to said inner tracks is accomplished entirely with tab-and-slot construction techniques.

15. A drawer cabinet having first and second, spaced apart, parallel, vertical side walls joined at front edges thereof by a front surface, said drawer cabinet having at least one two-track drawer slide assembly having the function of a three-track drawer slide assembly, said two-track drawer slide assembly comprising:

(a) first and second horizontal, parallel, oppositely disposed outer tracks axially slidably mounted in support means attached to said first and second side walls, respectively;

(b) first and second, parallel, inner tracks telescopingly axially moveable within said first and second outer tracks, said inner tracks being moveable between: (1) a first, closed position, with said inner tracks fully inserted in, and supported by, said outer tracks, and with said outer tracks fully disposed within said drawer cabinet, and (2) a second, withdrawn position, with said inner tracks being substantially fully withdrawn from said outer tracks past said front surface of said drawer cabinet, yet remaining supported by said outer tracks, and with said outer tracks fully disposed within said drawer cabinet;

(c) a frame attached to said first and second inner tracks, said frame not being fully withdrawn past said front surface of said drawer cabinet when said inner tracks are in said second, withdrawn position; and (d) co-engaging means attached to said inner and outer tracks to become engaged when said inner tracks are withdrawn to said second, withdrawn position, with further withdrawal of said inner tracks past said front surface of said drawer cabinet causing said outer tracks to move axially partially outwardly of said front surface of said drawer cabinet, to move said inner tracks to a third, withdrawn position, to permit said frame to be fully withdrawn past said front surface of said drawer cabinet;

and wherein said frame comprises:

(e) spaced apart, parallel, front and rear stringers joined by an intermediate member disposed orthogonally to said front and rear stringers; and (f) said front and rear stringers and said intermediate member being joined together by upwardly extending tabs formed on said front and rear stringers, which tabs are inserted through complementarily shaped slots defined through said intermediate member near the ends thereof, said tabs being bent over to lock said front and rear stringers and said intermediate member together.

16. A drawer cabinet, as defined in claim 15, wherein:

said ends of said intermediate member are set into complementarily shaped depressions formed in said front and rear stringers so that upper surfaces of said stringers and said intermediate member are flush with each other.

17. A drawer cabinet, as defined in claim 16, wherein:

said front and rear stringers include side walls and end walls formed around the peripheral edges thereof and orthogonal to the upper surfaces thereof, such that said frame comprises planar surfaces having walls disposed at opposite distal edges thereof for the secure support therein of a parts bin.

18. A drawer cabinet, as defined in claim 15, wherein:

said front and rear stringers have end walls formed orthogonal to longitudinal surfaces of said stringers and said end walls include outwardly formed tabs which are inserted through complementarily formed slots in said inner tracks and which said tabs are then bent over to secure said frame to said inner tracks.

19. A drawer cabinet, as defined in claim 18, further comprising:

first dimples formed in said end walls, which first dimples engage complementarily formed second dimples formed in mating inner surfaces of said inner tracks to provide for locating said end walls with respect to said inner tracks prior to bending said tabs.

* * * * *

UNITED STATES PATENT AND TRADEMARK OFFICE

CERTIFICATE OF CORRECTION

PATENT NO. : 5,624,171
DATED : April 29, 1997
INVENTOR(S) : Joseph F. Soja and Chester M. Fudge It is certified that error appears in the above-indentified patent and that said Letters Patent is hereby corrected as shown below:

Element (b) of Claim 1 is amended as follows:

"said support means comprising at least one longitudinally vertical support member for each of said side walls of said cabinet, each vertical support member having a raised central portion and vertical flanges formed along front and rear edges of the support member for mounting said vertical support member to [and] an inside of each..."

Signed and Sealed this
Fifteenth Day of July, 1997

Bruce Lehman

*Attest:*

*Attesting Officer*

BRUCE LEHMAN

*Commissioner of Patents and Trademarks*